US006006914A

United States Patent [19]

Moore, Jr. et al.

[11] Patent Number: 6,006,914

[45] Date of Patent: Dec. 28, 1999

[54] GOLF SOUVENIR HOLDER

[76] Inventors: Frederick James Moore, Jr., 7009 Carrabelle Key, Mobile, Ala. 36695; Stephen Charles Moore, 51 N. Monterey St., Mobile, Ala. 36604

[21] Appl. No.: 09/048,451

[22] Filed: Mar. 26, 1998

[51] Int. Cl.[6] ..... B65D 85/00

[52] U.S. Cl. ..... 206/579; 206/315.1

[58] Field of Search ..... 206/214, 425, 206/232, 450, 776, 782, 466, 769, 315.1, 579

[56] References Cited

U.S. PATENT DOCUMENTS

| | | | |
|---|---|---|---|
| 4,449,310 | 5/1984 | Kline | 40/11 |
| 4,974,983 | 12/1990 | Givati | 206/232 X |
| 5,062,530 | 11/1991 | Mitsuyama | 206/425 |
| 5,193,852 | 3/1993 | Bachmeyer | 281/15.1 |
| 5,284,340 | 2/1994 | Laskso | 273/32 |
| 5,351,813 | 10/1994 | Golovan | 206/466 X |
| 5,387,010 | 2/1995 | Mohr | 281/43 |
| 5,480,192 | 1/1996 | Angerbauer et al. | 206/425 X |
| 5,489,121 | 2/1996 | Mohr | 281/43 |
| 5,636,872 | 6/1997 | Gamer et al. | 283/49 |

*Primary Examiner*—Jacob K. Ackun
*Attorney, Agent, or Firm*—Jones & Askew LLP

[57] ABSTRACT

A golf souvenir holder for safe keeping and display of golf score cards, tees, and pencils. The holder includes a backing sheet and a thin cover sheet of clear plastic film attached to the backing sheet. The cover sheet overlays the backing sheet and forms a first pocket having an opening for removably receiving a golf score card. The souvenir holder also includes a second pocket attached to the cover sheet adjacent the first pocket and having an opening for receiving a golf pencil or a golf tee. Desirably, the souvenir holder includes a third pocket for holding a golf pencil or golf tee and is adapted for engaging the rings of a ring binder.

4 Claims, 3 Drawing Sheets

GOLF SOUVENIR HOLDER

TECHNICAL FIELD

This invention relates to safe keeping of golf souvenirs, and more particularly relates to safe keeping and display of golf score cards, pencils, and tees.

BACKGROUND OF THE INVENTION

Avid golfers keep souvenirs such as score cards, pencils, and tees from the courses they play. Such souvenirs can be stored in a variety of conventional ways. For example, score cards can be stored in a file or a box or displayed in a scrap book by mounting the score cards on pages in the scrap book. Scrap books, however, are not suitable for storing and displaying golf pencils and golf tees without using adhesive or other means which can damage the souvenirs. Instead, pencils and tees are often stored in separate containers such as a cup or a box or a desk drawer. Furthermore, scrap book pages usually have a clear sheet adhered to an opaque sheet and can only display one side of a golf score card. Golf score cards are often two-sided and have to be removed from the sheets of a scrap book for full viewing.

Souvenirs stored separately are sometimes lost and are difficult to arrange for viewing in sets of souvenirs from the same golf course. Accordingly, there is need for an article for storing golf souvenirs, such as score cards, pencils, and tees, so that such items are safe and can be displayed or viewed in sets which include souvenirs from the same golf course.

SUMMARY OF THE INVENTION

This invention solves the above described problems in the art by providing a golf souvenir holder capable of safely storing and displaying a golf score card and a golf pencil or golf tee or both. Generally described, this golf souvenir holder comprises a backing sheet and a cover sheet of clear plastic film attached to the backing sheet so that the cover sheet overlays the backing sheet. The cover sheet, as attached to the backing sheet, forms a first pocket having an opening for removably receiving a golf score card within the first pocket between the cover sheet and the backing sheet. In addition, the souvenir holder includes a second pocket attached to the cover sheet adjacent the first pocket. The second pocket comprises a clear cover and has an opening for receiving a golf pencil or a golf tee within the second pocket. Preferably, the souvenir holder is adapted to be stored in a ring binder such that a plurality of the holders can be stored in a ring binder to form a collection of golf souvenirs. Desirably, the golf souvenir holder further comprises a third pocket attached to the cover sheet proximate the first pocket. The third pocket comprises a clear cover and has an opening for receiving a golf pencil or golf tee within the third pocket. Accordingly, the souvenir holder is useful for storing and displaying a full set of golf souvenirs including a score card, a tee and a pencil.

The backing sheet and the cover sheet are preferably made of a clear flexible plastic film. The backing sheet and cover sheet can be adhered to one another with means such as welding or adhesive. The souvenir folder desirably has one end having a plurality of holes for receiving the rings of a ring binder. Because both sheets are clear, both sides of a golf score card are visible while stored between the backing and cover sheets.

According to a particular embodiment, the first pocket of the souvenir holder for holding a golf score card includes two subpockets separated by a portion of the cover sheet formed by a pair of spaced parallel slits in the cover sheets. One of the subpockets receives one end of the score card through one of the parallel slits and another of the subpockets receives another end of the score card through another of the parallel slits.

The second and third pockets can be formed such that the cover sheet of the holder includes the second and third pocket covers and the openings in the second and third pockets comprise slits in the cover sheets so that the golf pencil and golf tee can be received between the cover sheet of the holder and the backing sheet. Alternatively, the second and third pockets can be constructed such that the second and third pocket covers are flexible plastic sheets attached to the cover sheet of the holder so that the golf pencil and golf tee can be received between the second and third pocket covers and the cover sheet of the holder. Desirably the second and third pockets are sized so that the golf pencil and golf tee fit tightly within respective ones of the second and third pockets so that the pencil and tee are held safely in the holder and do not shift within the holder or fall out of the holder.

According to a particular embodiment of the invention, the holder can include a second complete set of pockets for holding a second set of souvenirs including a score card, a golf tee, and a golf pencil. This embodiment includes a fourth pocket for storing a second score card and fifth and sixth pockets for holding a second tee and a second pencil.

Therefore, an objective of this invention is to provide for safe storage and convenient display of golf souvenirs including a score card, a golf tee, and a golf pencil.

Another object of this invention is to provide a holder for storing and displaying a full set of golf souvenirs so that the set can be viewed in its entirety.

Yet another object of this invention is to provide a holder for storing golf souvenirs in a ring binder.

Other objects, features, and advantages of the invention will become apparent from the following detailed description, drawings, and claims.

DETAILED DESCRIPTION OF DRAWINGS

Figure 1:
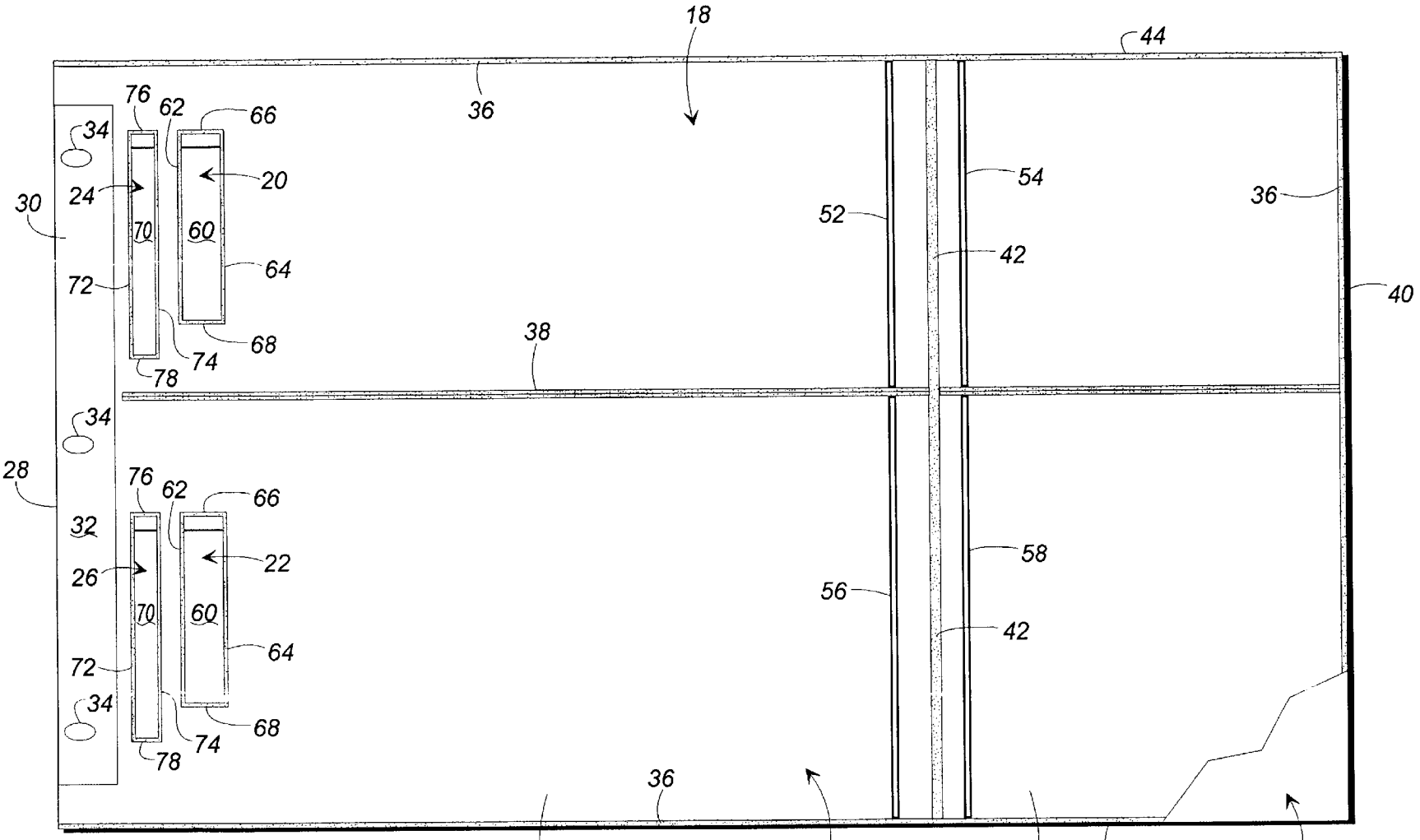
FIG. 1 is plan view of a golf souvenir holder made in accordance with an embodiment of the present invention.

As summarized above, this invention encompasses a holder for golf souvenirs such as golf score cards, tees and pencils. Turning to FIG. 1, a golf souvenir holder 10 made in accordance with an embodiment of this invention is illustrated. Generally described, this golf souvenir holder 10 comprises a backing sheet 12 of clear plastic film, a cover sheet 14 of clear plastic film attached to the backing sheet so that the cover sheet overlays the backing sheet, a pair of a juxtaposed score card pockets 16 and 18, a pair of corresponding tee pockets 20 and 22, and a pair of corresponding pencil pockets 24 and 26. Thus, the golf souvenir holder 10 accommodates two sets of golf souvenirs each set including a golf score card, golf tee, and a golf pencil.

The backing sheet 12 desirably comprises a clear flexible plastic film but can also be made of other materials such as rigid plastic, cardboard, paper, and the like. The backing sheet 12 can be clear or opaque. The golf souvenirs are actually viewed through the cover sheet 14 of the souvenir holder 10. When the backing sheet 12 is clear, the souvenirs can be viewed from both sides while stored in the holder 10.

The cover sheet 14 is clear so that the golf souvenirs can be viewed through the cover sheet. Suitable materials for the cover sheet 14 include films made of various polymers including polyolefins such as polyethylene, polypropylene, copolymers of ethylene and propylene, polyvinyl chloride, polystyrene, styrene butadiene styrene copolymer, and the like. The same materials can be used to make the backing sheet 12.

The souvenir holder 10 is desirably rectangular in shape and at one end of the souvenir holder, a portion 30 of the backing sheet 12 is adapted for engaging the rings of a ring binder so that the souvenir holder can be stored in a ring binder. A plurality of the souvenir holders can be stored in a ring binder to create a souvenir booklet. The portion 30 of the backing sheet 12 for engaging the rings of the ring binder includes a strip 32 of reinforcing plastic film and a plurality of holes 24 for receiving the rings.

The backing sheet 12 and cover sheet 14 of the souvenir holder 10 are desirably attached together by heat welding such as by pressing the two sheets between an anvil and a die, at least one of which is heated to a temperature sufficient to fuse the sheets together where the die contacts the sheets. The backing sheet 12 and cover sheet 14 can be attached by other means, however, such as ultrasonic welding, adhesives, and the like. As described above, the backing sheet 12 and cover sheet 14 are attached together so as to form the card pockets 16 and 18, the tee pockets 20 and 22, and the pencil pockets 24 and 26. A peripheral weld 36 about the periphery of the cover sheet 14 and a longitudinal central weld 38 from the one end 28 of the holder 10 to an opposite end 40 of the holder form the card pockets 16 and 18. A transverse weld 42 extends between side edges 44 and 46 of the souvenir holder 10 and divide the card pockets 16 and 18 into subpockets 48*a*, 48*b*, 50*a* and 50*b*. The side edges 44 and 46 of the holder 10 extend between the ends 28 and 40 of the holder to give the holder the rectangular shape. A pair of slits 52 and 54 in the cover sheet 14 run along opposite sides of the transverse weld 42 from proximate the transverse weld to one side edge 44 of the holder 10 to form openings in the subpockets 48*a* and 50*a* in the first card pocket 16 for receiving a score card. Likewise, another pair of slits 56 and 58 run along opposite sides of the transverse weld 42 from proximate the transverse weld to the other side edge 46 of the holder 10 to form openings in the subpockets 48*b* and 50*b* of the second card pocket 18 for receiving opposite ends of another score card. The slits 52, 54, 56 and 58 can be formed by a cutting die in the form of a stamp or a roller or the like.

The tee pockets 20 and 22 are formed adjacent respective card pockets 18 and 20. In the embodiment 10 illustrated in FIG. 1, the tee pockets 20 and 22 are positioned between the card pockets 16 and 18 and the end of the holder 28 with the ring binder holes 34. It should be understood, however, that the tee holders 20 and 22 can be positioned in variety of configurations relative to the card pockets 16 and 18. Each of the tee pockets 20 and 22 include a cover 60 made of clear plastic material. A souvenir tee fits beneath the clear plastic cover 60 for safe keeping and display. In the embodiment 10 illustrated in FIG. 1, the cover of the tee pockets 20 and 22 are integral with the clear plastic cover sheet 14, but it should be understood that the tee pocket cover 16 can be formed by a separate strip of clear plastic adhered to the cover sheet 14 by welding or adhesive. When the cover 60 of the tee pockets 20 and 22 is integral with the cover sheet 14, the souvenir tees fit between the tee pocket cover 60 and the backing sheet 12. When the tee pocket cover 60 is formed by separate clear sheet of plastic, the souvenir tee fits between the tee pocket cover and the cover sheet 14.

In the embodiment 10 illustrated in FIG. 1, the tee pocket covers 60 are welded to the backing sheet 12 by welding or adhesive to form longitudinal edges 62 and 64 spaced from one another and extending between a top slit or opening 66 to a bottom end 68 to form substantially rectangular pockets. The tee pockets 20 and 22 are sized so that a souvenir tee fits tightly within the pocket so that the tee remains secure inside the pocket. The top slit 66 in the tee pockets 20 and 22 can also be formed by a cutting die and the welded longitudinal edges 62 and 64 can be formed by a heated die/anvil arrangement.

The pencil pockets 24 and 26 have a structure similar to that of the tee pockets 20 and 22, except that the pencil pockets are sized so that golf pencils fit tightly inside the pockets for safe keeping. Each of the pencil pockets 24 and 26 include a clear plastic cover 70 for covering the pencils. The pencils can be viewed through the clear plastic pencil pocket covers 70. The pencil pocket cover 70 are adhered to the backing sheet 12 along longitudinal edges 72 and 74 which extend from a top slit or opening 76 to a bottom 78 to form rectangular shaped pencil pockets. In the embodiment 10 illustrated in FIG. 1, the pencil pocket covers 70 are integral with the cover sheet 14. The top slit 76 is formed by a cutting die and the longitudinal edges 72 and 74 can be adhered to the backing sheet 12 with welding or adhesive.

As with the tee pockets 20 and 22, the pencil pocket covers 70 can be formed with a separate sheet of clear plastic material adhered directly to the cover sheet 14 along longitudinal edges. In this alternative embodiment, the pencil would fit between the pencil pocket cover 70 and the cover sheet 14. In the embodiment 10 illustrated in FIG. 1, the pencil fits between the pencil pocket cover 70 and the backing sheet 12.

The pencil pockets 24 and 26 are shown in FIG. 1 adjacent respective tee pockets 20 and 22. It should be understood, however, that the pencil pockets 24 and 26 can be arranged in a variety of configurations with respect to the tee pockets and the card pockets 16 and 18.

Figure 2:
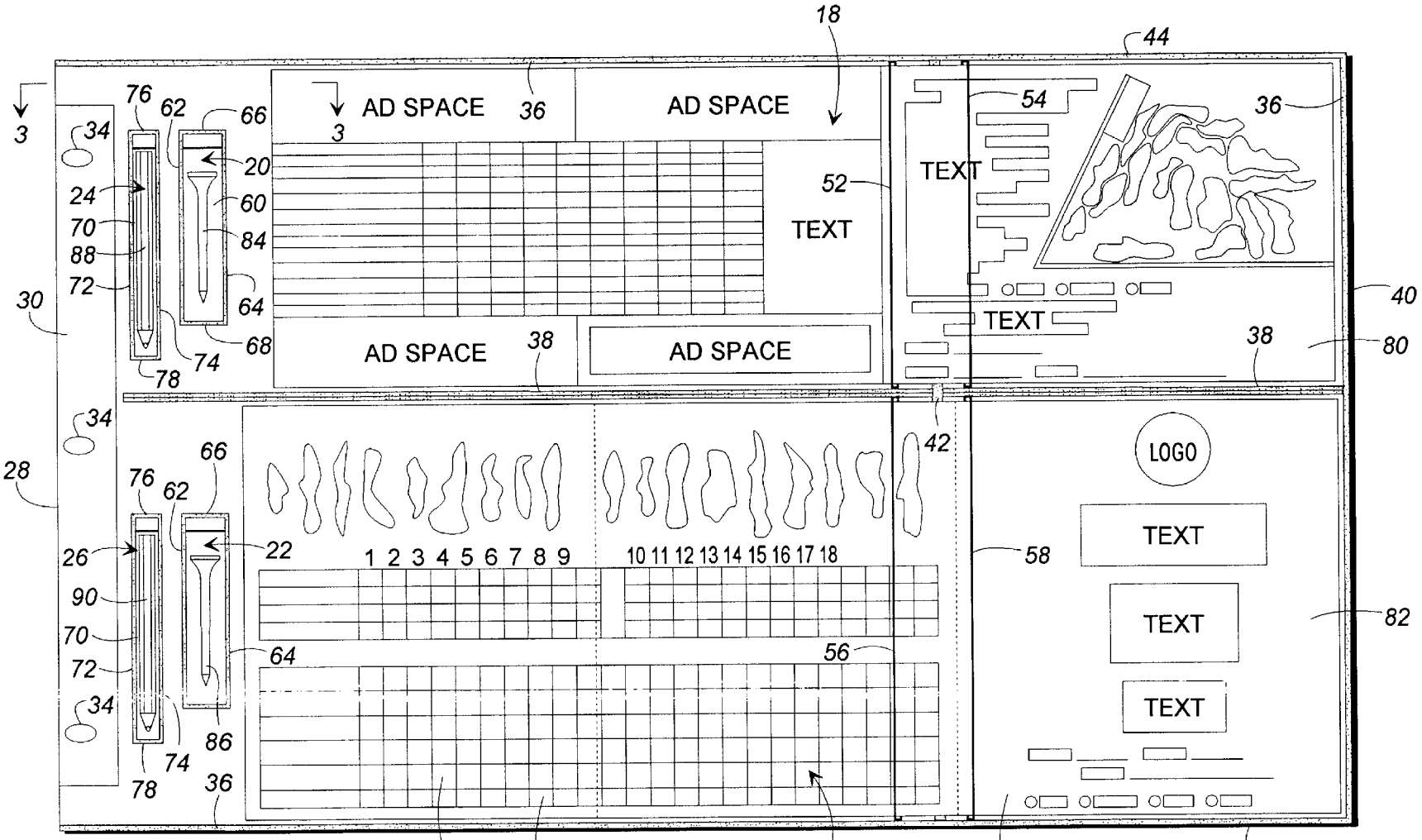
FIG. 2 is a plan view of a golf souvenir holder of FIG. 1 containing golf score cards, pencils, and tees.
Figure 3:
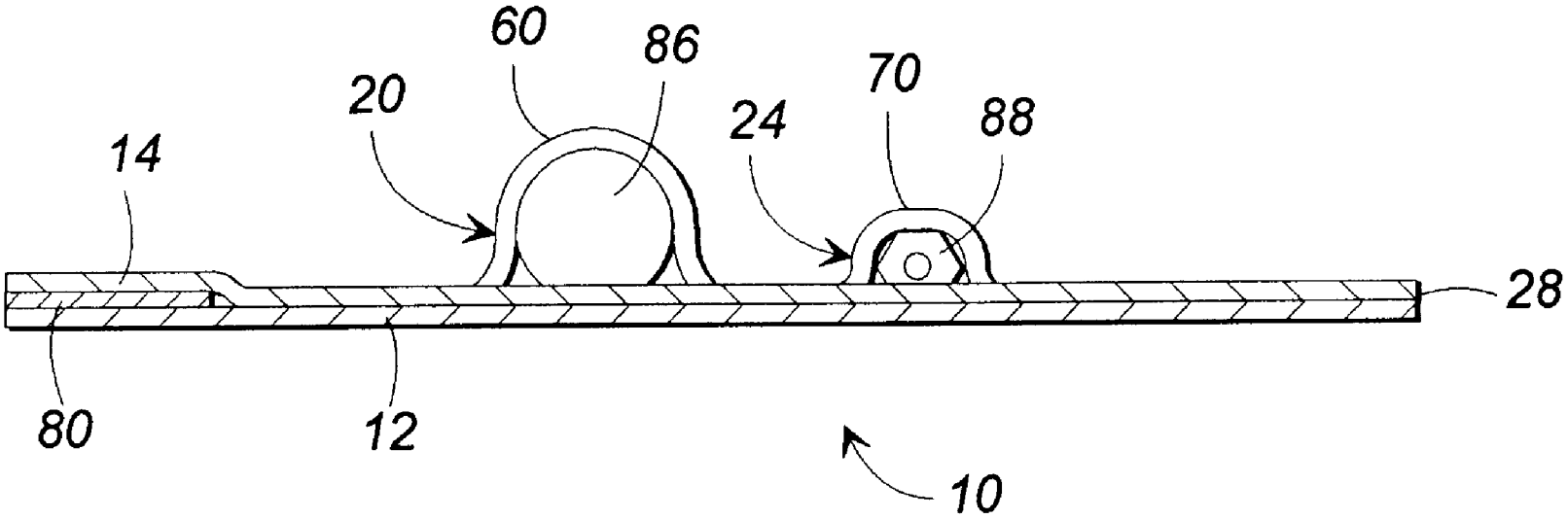
FIG. 3 is partial sectional view of the filled golf souvenir holder shown in FIG. 2 illustrating the souvenirs in their pockets.

FIG. 2 illustrates the golf souvenir holder 10 with two sets of golf souvenirs stored in the pockets. As can be seen, a first score card 80 is stored in the first card pocket 16 so that the first score card is visible through the clear plastic cover sheet 14. The first score card 80 is stored in the first card pocket 16 by inserting one end of the first card into the first subpocket 48*a* of the first pocket through the appropriate slit 52 and inserting an opposite end of the first score card into the second subpocket 50*a* through the appropriate slit 54. After the first score card 80 is completely inserted into the first card pocket 16, a portion of the first score card is exposed between the slits 52 and 54 in the first pocket. The first score card 80 can be removed from the first pocket 16 by grasping this exposed portion of the first score card and pulling the first score card out of the first pocket.

A second score card 82 can be stored in the second card pocket 18 in the same manner as the first score card 80 is stored. One end of the second score card 82 is inserted in the first subpocket 48*b* of the second card pocket 18 through the appropriate slit 56 and an opposite end of the second score card is inserted into the second subpocket 50*b* through the appropriate slit 58 in the cover.

Tees 84 and 86 are stored in respective tee pockets and 22 by inserting the tees through the top slits 66 in the tee pockets and sliding the tees under the respective tee pocket cover 60. Likewise, golf pencils 88 and 90 are stored in the pencil pockets 24 and 26 by inserting the pencils through the top slits 76 underneath the respective pencil pocket covers 70.

The golf souvenir holder 10 is suitable for storage in a three-ring binder. A plurality of golf souvenir holders 10 can be stored in a ring binder to create a souvenir booklet. Although the souvenir holder 10 illustrated in FIG. 1 is suitable for holding two sets of golf souvenirs, it should be understood that the souvenir holder can be sized and configured to hold any number of golf souvenir sets. Desirably, the card pockets 16 and 18, and in particular, the tee pockets 20 and 22 and the pencil pockets 24 and 26, are sized so that the respective souvenirs fit tightly in those pockets so that the souvenirs should not shift within or fall out of the pockets.

Although the sizes of the pockets can vary to some extent, preferred dimensions for the holder 10 are as follows. The holder 10 is 14.5 inches long and 11 inches wide. The first pocket 16 is 12 ½ inches long extending from the first tee pocket 20 to the opposite end 40 of the holder 10. The first pocket 16 is also 4.75 inches wide extending transversely from longitudinal central weld 38 to the adjacent side edge 44. The transverse weld 42 is positioned 10 inches from the holder end 28 which engages the ring binder. The slits 52 and 54 in the first card pocket 16 are spaced 0.75 inches apart. The dimensions of the second pocket card 18 are the same as those of the first card pocket 16 except that the second card pocket has a width of 6.15 inches extending from the central longitudinal weld 38 to the respective side edge 46.

Each of the tee pockets 20 and 22 is 0.5 inches wide and 2.75 inches wide long. The top slit or opening 66 of each tee pocket 20 and 22 is 0.5 inches long, corresponding to the width of the tee pockets. The longitudinal edge 64 of each tee pocket 20 and 22 closest to the adjacent card pocket is two inches from the end 28 of the holder proximate the holes 34 for the ring binder.

Each of the pencil pockets 24 and 26 is 0.3 inches wide and 3.25 inches long. The top slit or opening 76 of each pencil pocket 24 and 26 is 0.3 inches long and the longitudinal edge 72 of each pencil pocket closest to the adjacent tee pocket is 1.25 inches from the one end 28 of the holder 10 proximate the ring binder holes 34.

It should be understood that the foregoing relates to particular embodiments of the present invention, and that numerous changes may be made with without departing from the scope of the invention as defined the following claims.

I claim:

1. A golf souvenir storage and display comprising:

a souvenir holder comprising:

a backing sheet of clear flexible plastic film;

a cover sheet of clear flexible plastic film attached to the backing sheet so that the cover sheet overlays the backing sheet and forms a first pocket having an opening for removably receiving a golf score card within the first pocket between the cover sheet and the backing sheet, wherein the first pocket is sized and shaped so that the golf score card fits tightly within the first pocket; and a second pocket attached to the cover sheet adjacent the first pocket, the second pocket comprising a clear cover and having an opening for receiving a golf pencil or a golf tee within the second pocket, wherein the second pocket is sized and shaped so that the golf pencil or golf tee fits tightly within the second pocket;

a golf score card disposed in the first pocket; and a golf pencil or golf tee disposed in the second pocket.

2. A golf souvenir storage and display as in claim 1 wherein the holder further comprises a third pocket attached to the cover sheet proximate the first pocket, the third pocket comprising a clear cover and having an opening for receiving a golf pencil or a golf tee within the third pocket, wherein the third pocket is sized and shaped so that the golf pencil or golf tee fits tightly within the third pocket; and the storage and display further comprises a golf pencil or golf tee disposed in the third pocket.

3. A golf souvenir storage and display as in claim 1 further comprising an end portion extending from one end of the souvenir holder for engaging rings of a ring binder.

4. A golf souvenir storage and display as in claim 3 further comprising a ring binder, the end portion of the holder engaged with rings of the ring binder.

* * * * *